US010871276B1

(12) United States Patent
Lan et al.

(10) Patent No.: US 10,871,276 B1
(45) Date of Patent: Dec. 22, 2020

(54) SIMPLE WATERTIGHT LAMP AND STRING LAMP

(71) Applicant: SHENZHEN GUANKE TECHNOLOGIES CO., LTD, Shenzhen (CN)

(72) Inventors: Qing Lan, Shenzhen (CN); Yuting Hou, Shenzhen (CN); Ligen Liu, Shenzhen (CN); Shoubao Chen, Shenzhen (CN); Wenhao Lin, Shenzhen (CN)

(73) Assignee: SHENZHEN GUANKE TECHNOLOGIES CO., LTD, Shenzhen (CN)

( * ) Notice: Subject to any disclaimer, the term of this patent is extended or adjusted under 35 U.S.C. 154(b) by 0 days.

(21) Appl. No.: 16/713,362

(22) Filed: Dec. 13, 2019

(30) Foreign Application Priority Data

Sep. 12, 2019 (CN) ..... 2019 2 1550413 U

(51) Int. Cl.

| | |
|---|---|
| ***F21V 17/00*** | (2006.01) |
| ***F21V 31/00*** | (2006.01) |
| ***F21V 17/08*** | (2006.01) |
| ***F21V 23/06*** | (2006.01) |
| ***F21V 17/12*** | (2006.01) |
| ***F21V 29/77*** | (2015.01) |
| ***F21S 4/10*** | (2016.01) |
| ***F21V 17/16*** | (2006.01) |

(52) U.S. Cl.
CPC ..... *F21V 17/002* (2013.01); *F21S 4/10* (2016.01); *F21V 17/08* (2013.01); *F21V 17/12* (2013.01); *F21V 17/164* (2013.01); *F21V 23/06* (2013.01); *F21V 29/773* (2015.01); *F21V 31/005* (2013.01)

(58) Field of Classification Search
CPC ..... F21V 21/005; H01R 33/18
See application file for complete search history.

(56) References Cited

U.S. PATENT DOCUMENTS

| | | | | |
|---|---|---|---|---|
| 6,150,611 | A * | 11/2000 | Imai | H01R 9/0524 174/78 |
| 2009/0273289 | A1* | 11/2009 | Sun | F21S 4/10 315/185 S |
| 2017/0184284 | A1* | 6/2017 | Van Winkle | F21V 23/04 |
| 2018/0202636 | A1* | 7/2018 | Fox | F21V 21/116 |
| 2019/0341718 | A1* | 11/2019 | Yu | H01R 33/09 |

* cited by examiner

*Primary Examiner* — Evan P Dzierzynski
(74) *Attorney, Agent, or Firm* — Maier & Maier, PLLC

(57) ABSTRACT

A simple watertight lamp and string lamp, including: lamp housing set with a mounting groove and two mounting blocks, containing a mounting hole connecting the mounting groove which is used for mounting the luminous module; hanger loop which is back on one side of the mounting groove together with the lamp housing and connects with the lamp housing to form a hanger loop mouth; two watertight covers set with a wire hole and can be dismounted and connected with mounting block, enabling that the watertight cover and the mounting block fit each other to seal the wire which goes through the wire hole; and lampshade which is mounted to the lamp housing in the sealed mounting groove. This realizes relatively independent wires and lamp by virtue of two watertight covers and the lamp housing of a removable structure, improving the mounting and maintenance efficiency of string lamp.

18 Claims, 8 Drawing Sheets

SIMPLE WATERTIGHT LAMP AND STRING LAMP

CROSS-REFERENCE TO RELATED APPLICATIONS

This application claims the priority of Chinese Patent Application No. 201921550413.1 filed on Sep. 12, 2019, the disclosure of which is incorporated herein by reference.

TECHNICAL FIELD

The utility model relates to the lighting equipment field, especially relating to the said simple watertight lamp and the string lamp thereof.

BACKGROUND

The string lamp is a product that has a cable connecting several lamps. To guarantee the water tightness performance of the string lamp, usually the wire of the string lamp and the housing of the lamp form an integrated structure, namely the wire and the lamp are inseparable. Since the integrated structure design of wire and lamp, there are some difficulties in assembling wire and lamp, and artificial replacement of only wire or only lamp cannot be realized, resulting in low installation and maintenance efficiency of the string lamp.

The foregoing content is only used for assisting in understanding the technical scheme of the invention but not mean the acknowledgement of that the above content is an existing technology.

SUMMARY

The utility model is mainly used for claiming a simple watertight lamp and aims at solving the technical problem of improving the installation and maintenance efficiency of the string lamp.

To realize the above purpose, the utility model claims a simple watertight lamp, comprising:

The said lamp housing set with a mounting groove and two mounting blocks, containing a mounting hole connecting the said mounting groove which is used for mounting the luminous module;

Hanger loop which is back on one side of the said mounting groove together with the said lamp housing and connects with the said lamp housing to form a hanger loop mouth;

Two watertight covers each of which is set with a wire hole and can be dismounted and connected with each said mounting block, enabling that the said watertight cover and the said mounting block fit each other to seal the wire which goes through the said wire hole; and A lampshade which is installed to the said lamp housing and sealed in the said mounting groove.

In one embodiment of the utility model, the bottom wall of the said mounting groove is set with several protruding buckle placement positions each of which connects with the side wall of the said mounting groove to form a limited space;

The inner wall of the said lampshade is set with several buckles;

The periphery of the said lampshade is located in several said limited spaces, enabling the said lampshade is installed to the said lamp housing by virtue of matching of several buckles and several buckle placement positions.

In one embodiment of the utility model, peripheral wall of the said lampshade is set with an alignment groove;

The inner wall of the said mounting groove is set with protruding limited posts which are set together with the several said buckle placement positions in the manner interval;

The periphery of the said lampshade is located in several said limited spaces, and the said limited post is contained in the said alignment groove.

In one embodiment of the utility model, the peripheral wall of the said lampshade is also set with protruding airtight rubber strips which are set around the peripheral wall of the said lampshade;

The periphery of the said lampshade is located in several said limited spaces, and there is elastic compression between the said airtight rubber strip and the said mounting groove.

In one embodiment of the utility model, the said luminous module consists of a lamp panel and the diode bead for electric connection of the said lamp panel, the said lamp panel is set onto the bottom wall of the said mounting groove, and the said diode bead is set onto the said lamp panel back on one side of the said lamp housing.

In one embodiment of the utility model, each mounting block consists of the block body set to the said lamp housing and several sealed protruding rubber strips connected with the said block body, and several said protruding sealing rubber strips are set around the said mounting hole;

The said watertight cover and the said block body can be dismounted and connected, and there is elastic compression between the watertight cover and several said protruding sealing rubber strips, enabling several said protruding sealing rubber strips to go closer to the said mounting hole and sealing wire.

In one embodiment of the utility model, there are mounting threads on the outer wall of the said block body, the said watertight cover contains internal threads, and the said watertight cover and the said mounting block can be dismounted and connected by virtue of matching of the said internal thread and the said mounting thread.

In one embodiment of the utility model, the said simple watertight lamp also comprises two sealed casing rings each of which is contained in each mounting hole;

There is elastic compression between the said watertight cover and the said several protruding sealing rubber strips, enabling that several said protruding sealing rubber strips press the said sealed casing ring to make the wire be sealed in the sealed casing ring.

In one embodiment of the utility model, the surface of the said lampshade is set with several anti-collision rubber strips which are set in the manner of interlacing to form a net structure.

The utility model also claims a string lamp which comprise a plug, sealing cover and several said simple watertight lamps, the said plug connects electrically with the luminous module of several said simple watertight lamps via wire consecutively; the said sealing cover and the mounting block at the farthest end of the plug can be dismounted and connected, and the said sealing cover can seal the said mounting block at the farthest end.

In the technical scheme of the utility model, the lamp housing is set with a hanger loop which facilitates locating and mounting of the lamp. In addition, the lamp housing is set with a mounting groove and two mounting blocks each of them is set with a mounting hole to facilitate that several wires go through the mounting hole and connect electrically with the luminous module in the mounting groove electrically; Each watertight cover is set with a wire hole, and the watertight cover and the mounting block can be dismounted and connected, enabling wire to be sealed by matching the watertight cover and the mounting block, namely the wire connects with the luminous module electrically after going through and wire hole and the mounting hole; what's more, installing of the watertight cover to the mounting block enables that the watertight cover and the mounting block match and clamp to seal the wire to make from a structure where wire is relatively independent of the lamp housing. Additionally, the lampshade is installed to the said lamp housing and sealed in the said mounting groove to make the lampshade cover the luminous module so that the luminous module can be protected from pollution of external matters, and the lampshade is equipped with a certain anti-collision capacity, which can improve the service life of the lamp, improve the tightness of the said simple watertight lamp and enable the lamp to be used in severe environments.

BRIEF DESCRIPTION OF THE DRAWINGS

To better describe the cases adopting this utility model embodiment or the technical schemes of current technologies, a brief introduction of the figures to be used in the descriptions of embodiment or current technologies is made hereby. Obviously, the attached figures described below are only several embodiments of this utility model. For common technicians in this field, they can obtain other attached figures based on these without making additional creative endeavors.

FIG. 4 is the cross-sectional structural schematic diagram of the string lamp in

FIG. 3;

The implementation, functional characteristics and advantages of the utility model will be further illustrated hereinafter in conjunction with the embodiments and accompanying figures.

DETAILED DESCRIPTION

A clear and complete description of the technical schemes combined with the attached figure in utility model embodiments, this utility model embodiments clearly and completely describe the technical programs. Obviously, only some embodiments of this invention (instead of all the utility model embodiments) are described here. Based on the embodiment of the utility model, all other embodiments acquired by the common technicians in this field without creative work, shall be in the protection scope of this utility model.

It should be noted that, if there is a directional indication (upper, lower, left, right, front, rear, etc.) in the embodiment of the utility model, the directional indication is only used to explain the relative positional relationship, motion condition, etc. between the components in a particular position (as shown in the Figure), and if the particular attitude is changed, the directional indication is changed accordingly.

In addition, if there are descriptions relating to "first", "second" and the like in embodiments of the utility model, such descriptions of "first", "second" and the like are for descriptive purposes only and are not to be construed as indicating or implying their relative importance or implying an indication of the number of indicated technical features. As such, a feature that defines as "first", "second" may explicitly or implicitly include at least one of that features. In addition, the "and/or" as stated in the whole text should be understood as there are three paralleled schemes where scheme A, or scheme B or scheme A and scheme B can be met at the same time (taking "A and/or B as an example"). In addition, the technical schemes of embodiments may be combined with each other, but must be available for common technicians in this field, and when the combination of the technical scheme is contradictory or impossible, it should be considered that the combination of the technical scheme does not exist and not fall within the scope of the utility model.

Figure 1:
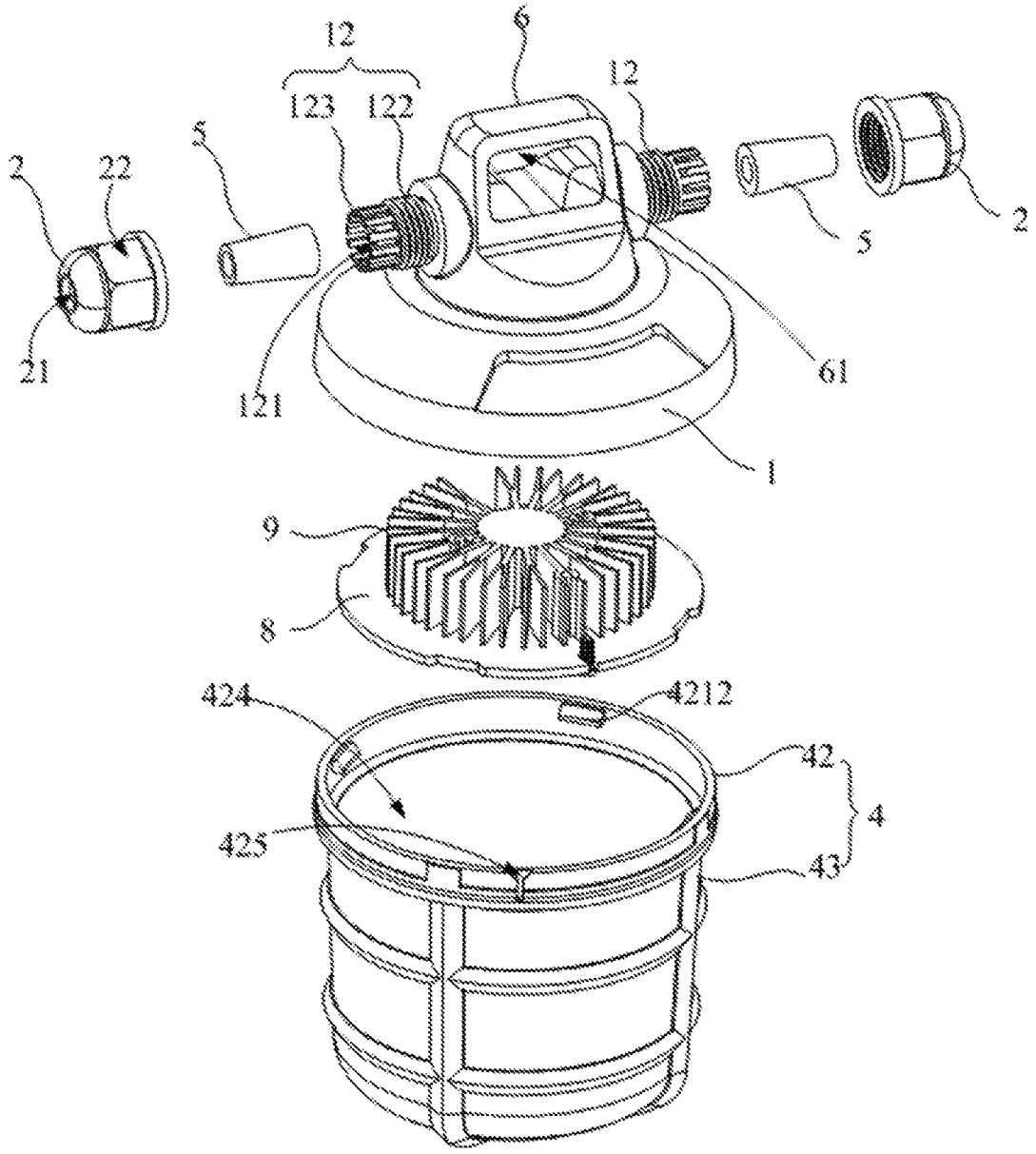
FIG. 1 is the assembly structural schematic diagram of one embodiment of simple watertight lamp of the utility model.
Figure 2:
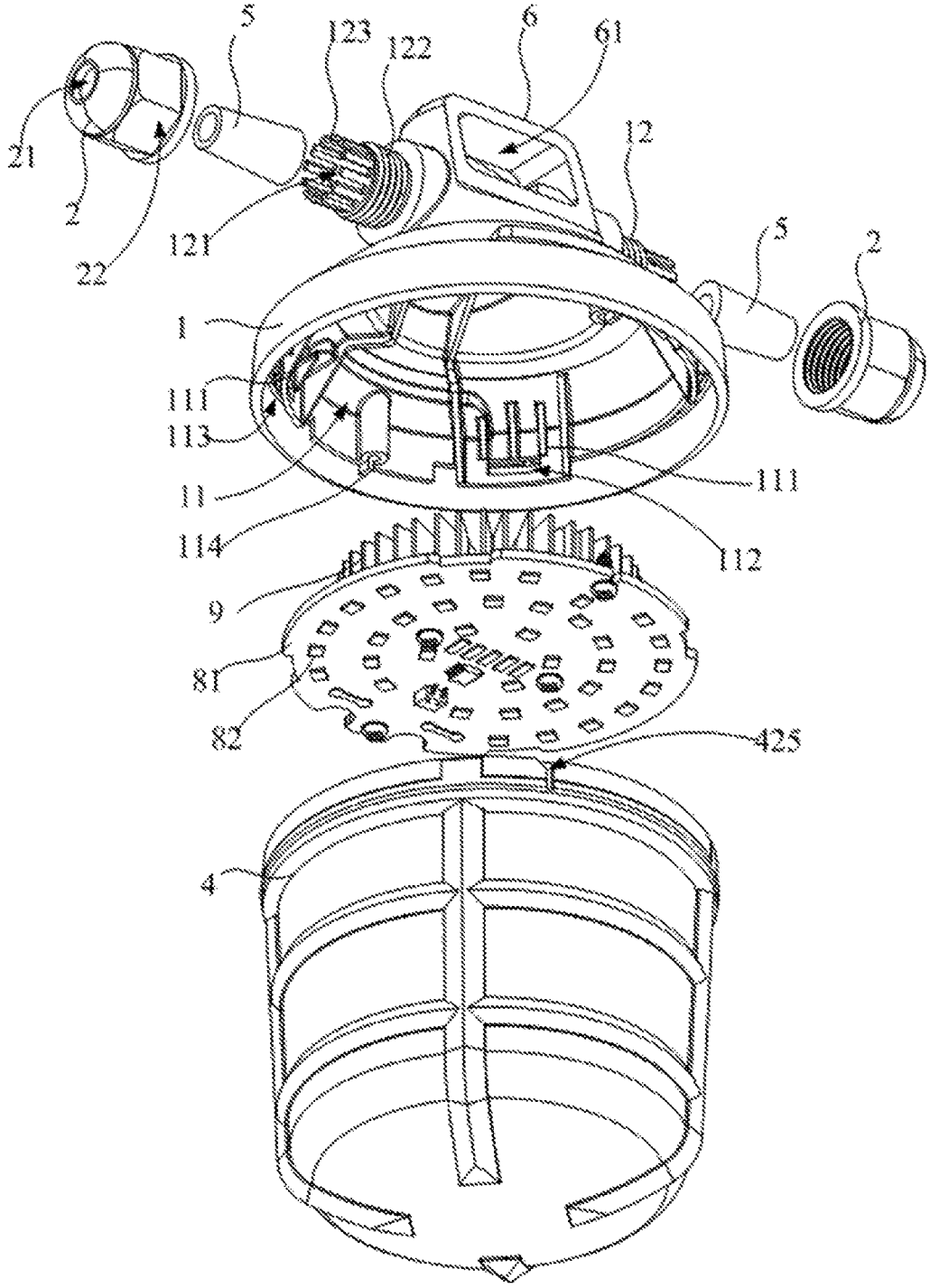
FIG. 2 describes the assembly structure of the simple watertight lamp in FIG. 1.
Figure 3:
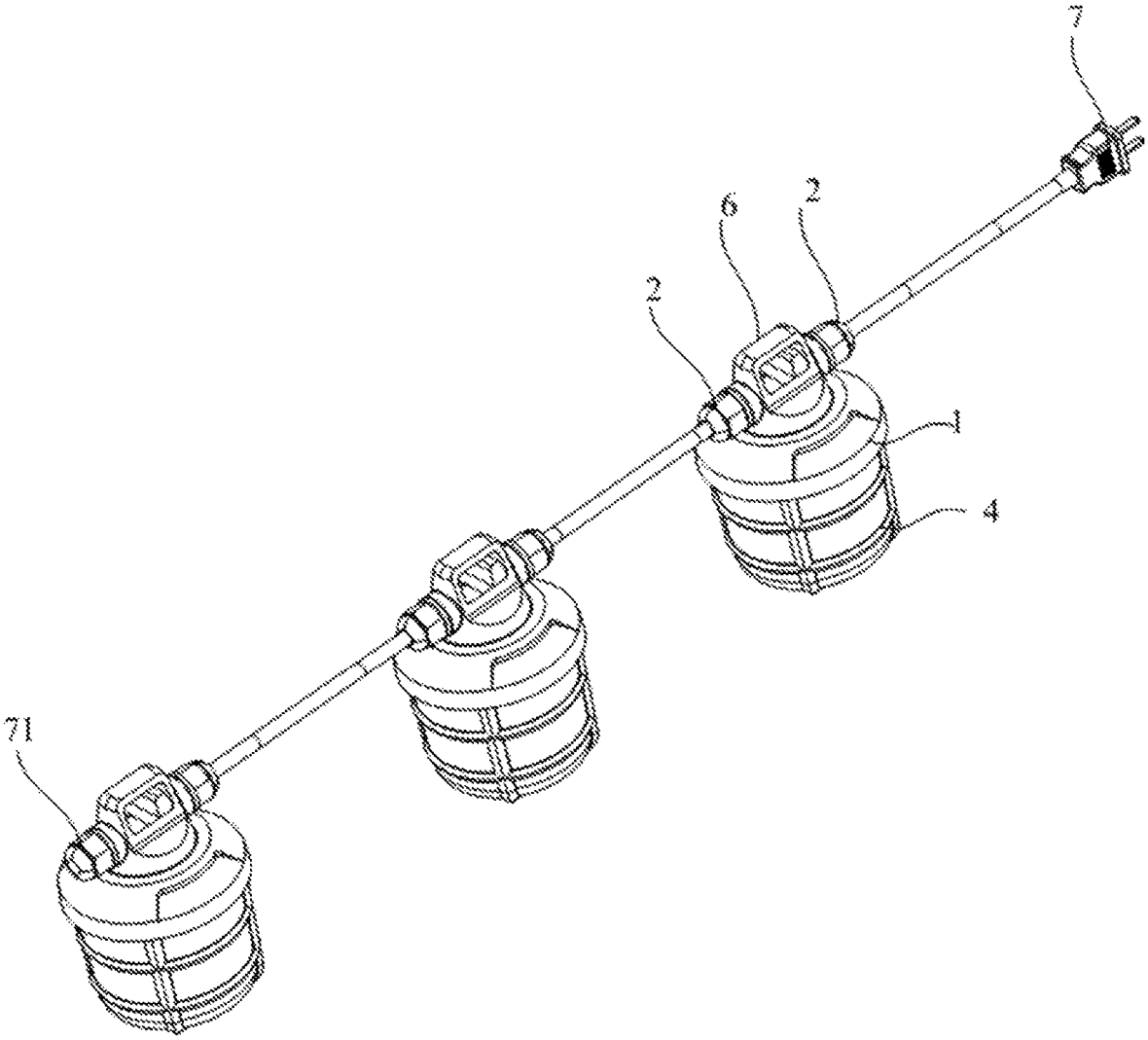
FIG. 3 is a structural schematic diagram of an embodiment of a string lamp of the utility model.
Figure 4:
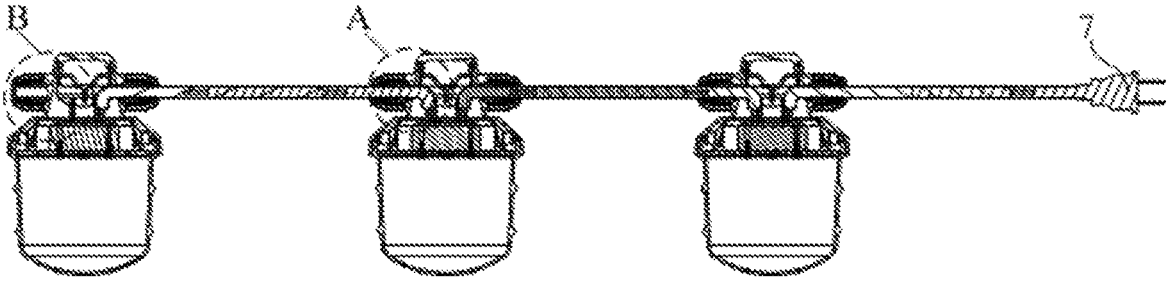
Figure 6:
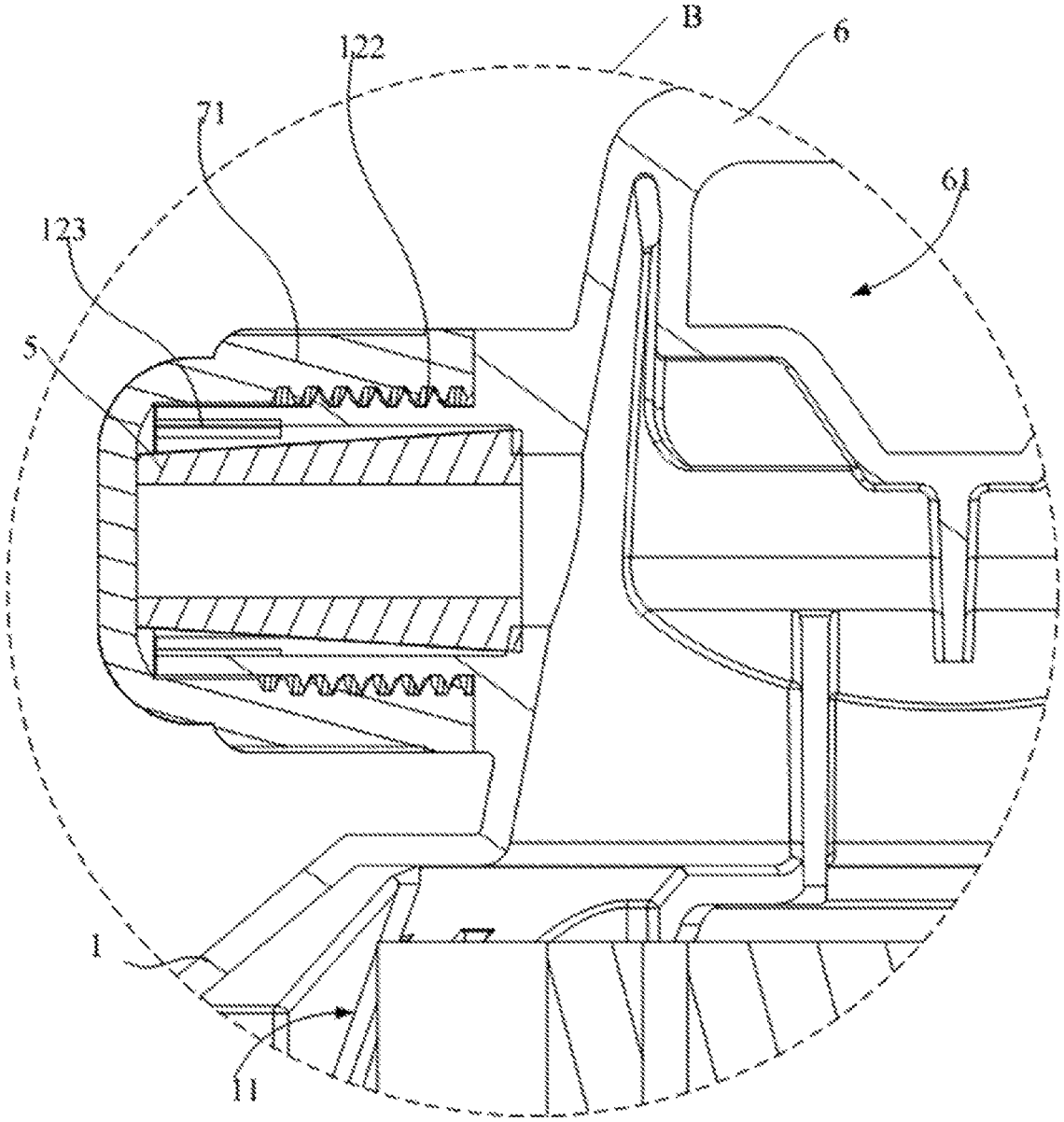
FIG. 6 is the partial enlarged figure of section B in FIG. 4.

The utility model claims a simple watertight lamp applied to string lamp, and several said simple watertight lamps can connect via wires to form string lamps. FIG. 1 is the assembly structural schematic diagram of one embodiment of simple watertight lamp of the utility model for reference; Reference Diagram 2 is another assembly structural schematic diagram of the simple watertight lamp in FIG. 1; Reference Diagram 3 is a structural schematic diagram of an embodiment of a string lamp of the utility model; Reference Diagram 4 is the cross-sectional structural schematic diagram of the string lamp in FIG. 3; Reference Diagram 5, is the partial enlarged figure of section A in FIG. 4; Refer to FIG. 6 for the partial enlarged figure of section B in FIG. 4.

In embodiments of the utility model, as shown in FIG. 1 in combination with FIGS. 2, 3, 4, 5 and 6, the simple watertight lamp comprises: lamp housing 1, hanger loop 6, two watertight covers 2 and lampshade 4; the hanger loop 6 is installed to the lamp housing 1, and two watertight covers 2 and lampshade 4 are installed to lamp housing 1.

The lamp housing 1 is set with a mounting groove 11 and two mounting blocks 12. Each mounting block 12 contains a mounting hole 121 connecting the mounting groove 11 which is used for mounting the luminous module 8. Understandably, two mounting blocks 12 can set onto lamp housing 1 oppositely to enable reverse setting of two mounting holes 121, namely two mounting blocks 12 stand in one line; alternatively, two mounting blocks 12 can be set onto the lamp housing 1 in parallel, enabling parallel setting of two mounting holes 121; or two mounting blocks 12 can be set onto the lamp housing 1 vertically, enabling setting of two mounting holes 121 and mounting groove 11 in the same direction.

The hanger loop 6 is set to the lamp housing 1 which backs on one side of the mounting groove 11 and work together with the lamp housing 1 to form the hanger loop mouth 61 in a manner of enclosure. In other words, the hanger loop 6 is set to the lamp housing 1 and work together with the lamp housing 1 to form the hanger loop mouth 61. When there is a need to hang the lamp, a clamp can be used for going through the hanger loop mouth 61 and fix the lamp to the target position. Wherein, the clamp can be a buckle structure or a rod structure. The target position means the fixing position of the lamp and also means the place where the user need to fix the lamp.

Each watertight cover 2 is set with a wire hole 21. Each watertight cover 2 and each mounting block 12 can be dismounted and connected, enabling that the watertight cover 2 and the mounting block 12 fit each other to seal the wire which goes through the wire hole 21; Understandably, each watertight cover 2 is set with a taper hole (not identified in the Figure), watertight cover 2 and mounting block 12 can be dismounted and connected, enabling that the end of mounting block 12 away from the lamp housing 1 press the inner wall of the taper hole so that the ends of mounting blocks 12 go closer to the sealing wire. For the convenience of understanding, it can also be expressed that each watertight cover 2 and each mounting block 12 can be dismounted and connected, and each watertight cover 2 and each mounting block 12 can be connected in the manner of buckling; or each watertight cover 2 and each mounting block 12 can apply threaded connection.

Lampshade 4 is installed to lamp housing 1 and sealed in mounting groove 11. Understandably, lampshade 4 and lamp housing 1 can apply threaded connection, buckling connection, screw connection, etc. In addition, to facilitate light transmission of luminous module 8, lampshade 4 is made of transparent or semi-transparent materials, such as polycarbonate or acrylic materials.

In this embodiment, lamp housing 1 is set with a hanger loop 6 to facilitate locating and installation of the lamp. In addition, the lamp housing 1 is set with a mounting groove 11 and two mounting blocks 12 each of them is set with a mounting hole 121 to facilitate that several wires go through the mounting hole 121 and connect electrically with the luminous module 8 in the mounting groove 11 electrically; Each watertight cover 2 is set with a wire hole 21, and the watertight cover and the mounting block 12 can be dismounted and connected, enabling wire to be sealed by matching the watertight cover 2 and the mounting block 12, namely the wire connects with the luminous module 8 electrically after going through and wire hole 21 and the mounting hole 121; what's more, installing of the watertight cover 2 to the mounting block 12 enables that the watertight cover 2 and the mounting block 12 match and clamp to seal the wire to make from a structure where wire is relatively independent of the lamp housing 1. Additionally, the lampshade 4 is installed to lamp housing 1 and sealed in mounting groove 11 to make the lampshade 4 cover the luminous module 8 so that the luminous module can be protected from pollution of external matters, and the lampshade 4 is equipped with a certain anti-collision capacity, which can improve the service life of the lamp, improve the tightness of the said simple watertight lamp and enable the lamp to be used in severe environments. Severe environment refers to that the environment where the lamp is placed have water or other sundries.

To enhance the intensity of lamp housing 1, at least one reinforcing bar should be set inside mounting groove 11 to improve the longitudinal and horizontal compressive intensity of lamp housing 1.

To facilitate wire installation, luminous module 8 and lamp housing 1 are fixed with bolts, leaving a space (not identified in the figure) between luminous module 8 and lamp housing 1. The space is used for contain wire.

To facilitate installation of luminous module 8, inner wall of mounting groove 11 is set with several locating pins (not identified in the figure), luminous module 8 is set with several locating mouths (not identified in the figure). When luminous module 8 connects with the bottom wall of the mounting groove 11, each locating pin should be inserted into each locating mouth.

Alternatively, hanger loop 6 and lamp housing 1 are an integrated structure formed through injection molding, enhancing the intensity between hanger loop 6 and lamp housing 1.

Alternatively, two ends of hanger loop 6 connect with two mounting blocks 12, and hanger loop 6, two mounting blocks 12 and lamp housing 1 work together to form hanger loop mouth 61 in the manner of enclosing.

In one embodiment of the utility model, the bottom wall of mounting groove 11 is set with several protruding buckle placement positions 111, and each buckle placement position 111 work together with the side wall of mounting groove 11 in the manner of enclosing to form a limited space 113;

The inner wall of lampshade 4 is set with several buckles 4212; Periphery of lampshade 4 is located in several limited spaces 113 so that lampshade 4 is installed to lamp housing 1 through matching of several buckles 4212 and several buckle placement positions 111.

In this embodiment, periphery of lampshade 4 is located in several limited spaces 113, which enables close fit between the periphery of lampshade 4 and the inner wall of mounting groove 11 so as to enhance the watertightness of the simple watertight lamp. Besides, quick installation of lampshade 4 and lamp housing 1 can be realized. With the installation mode of applying buckle 4212, the structure of lampshade 4 and lamp housing 1 is simplified.

In one embodiment of the utility model, each buckle placement position 111 is set with a buckle hole 112. When installing lampshade 4 to lamp housing 1, each buckle 4212 is located in each buckle hole 112.

In one embodiment of the utility model, peripheral wall of lampshade 4 is set with an alignment groove 425; The inner wall of mounting groove 11 is set with protruding limited posts 114 which are set with several buckle placement positions 111 at intervals; The periphery of lampshade 4 is located in several limited spaces 113, and limited post 114 is contained in alignment groove 425.

In this embodiment, the periphery of lampshade 4 is located in several limited spaces 113, limited post 114 is contained in alignment groove 425, so the installation alignment precision of lampshade 4 and lamp housing 1 can be improved through locating limit cooperation of alignment groove 425 and limited post 114; besides, relative rotation between lamp housing 1 and lampshade 4 can be avoided, improving the working stability of the simple watertight lamp.

Figure 7:
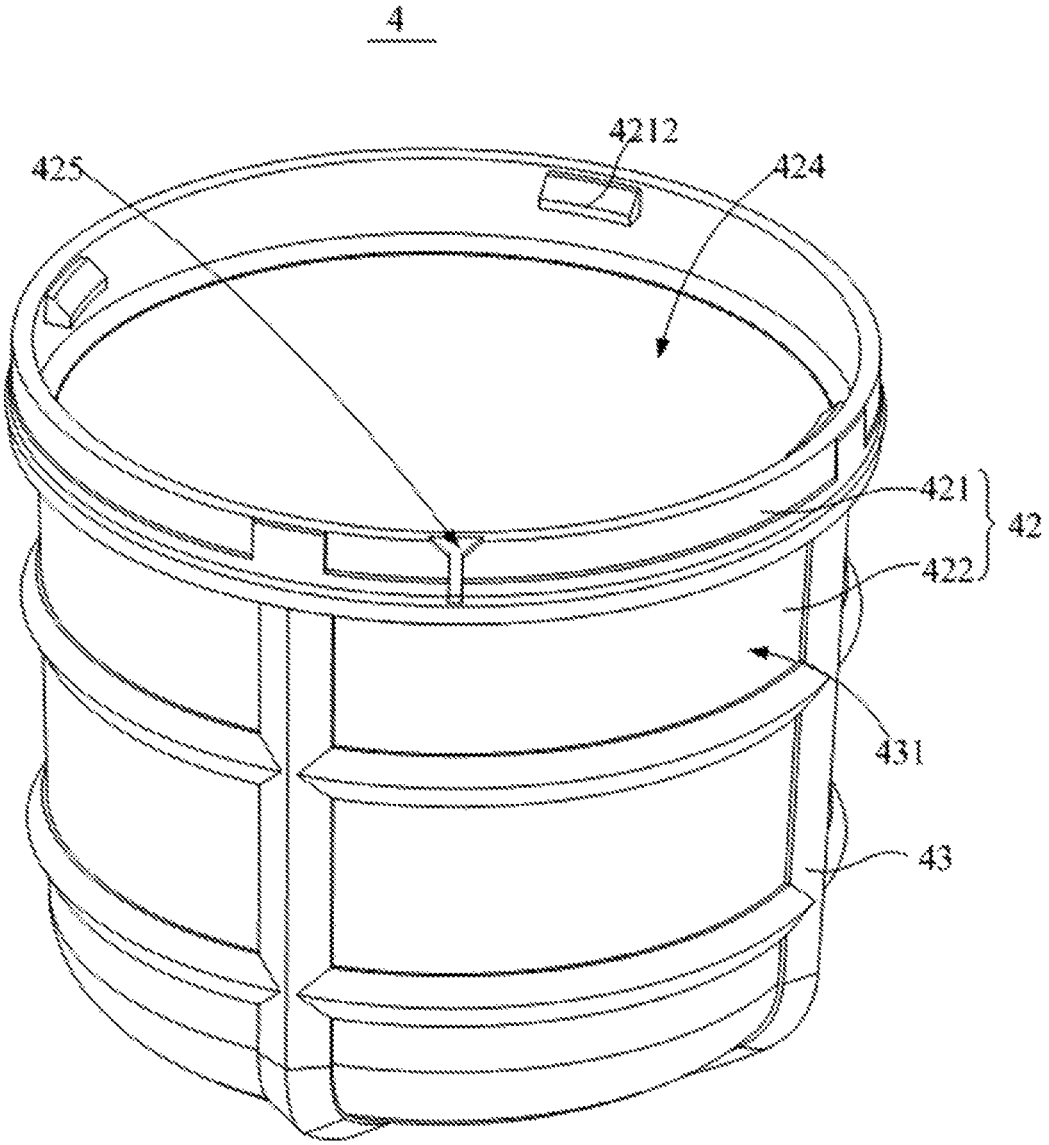
FIG. 7 shows a structural schematic diagram of lampshade.
Figure 8:
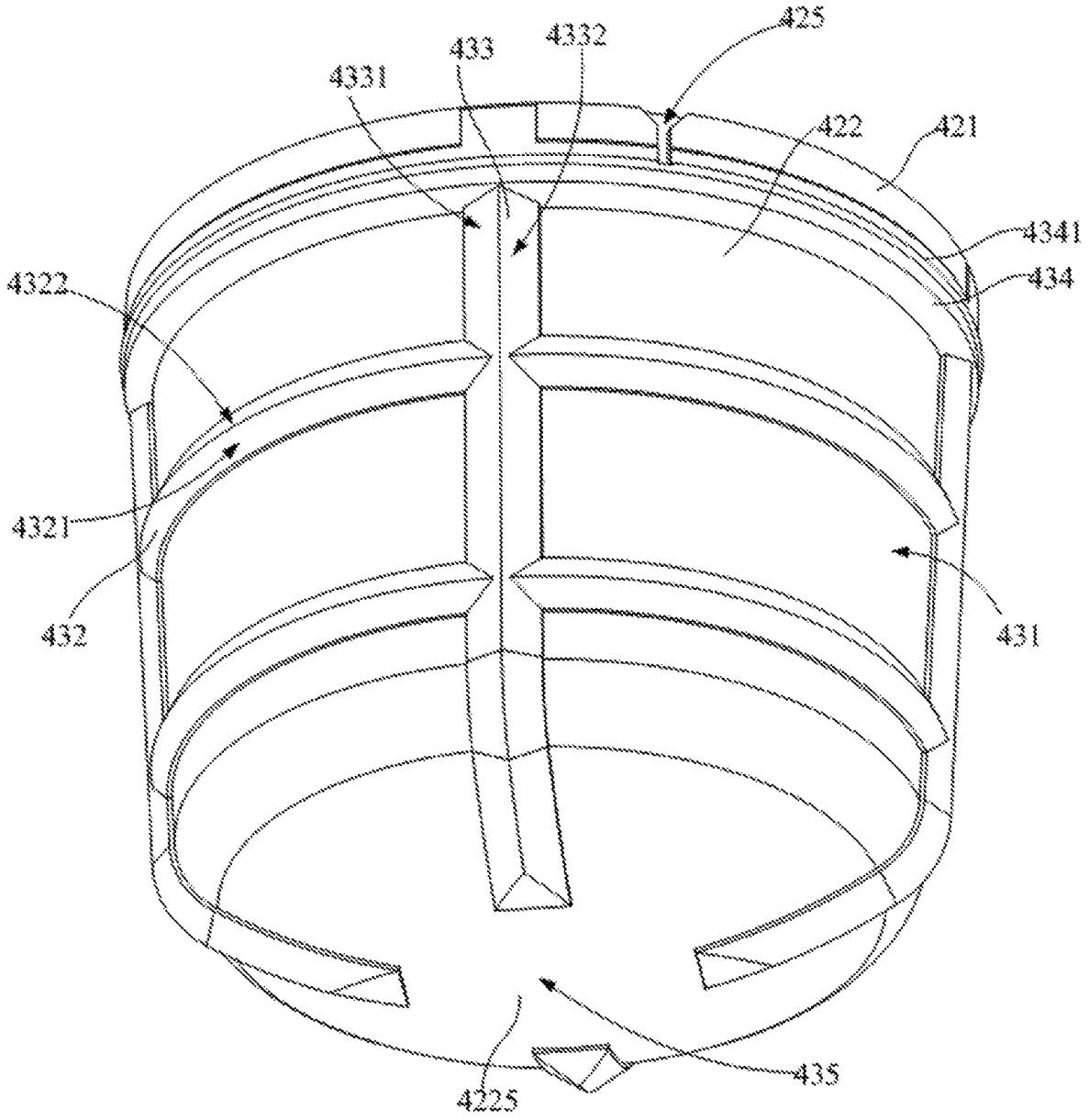
FIG. 8 is the structural schematic diagram of the anti-collision lampshade in FIG. 7 from another angle of view.
Figure 9:
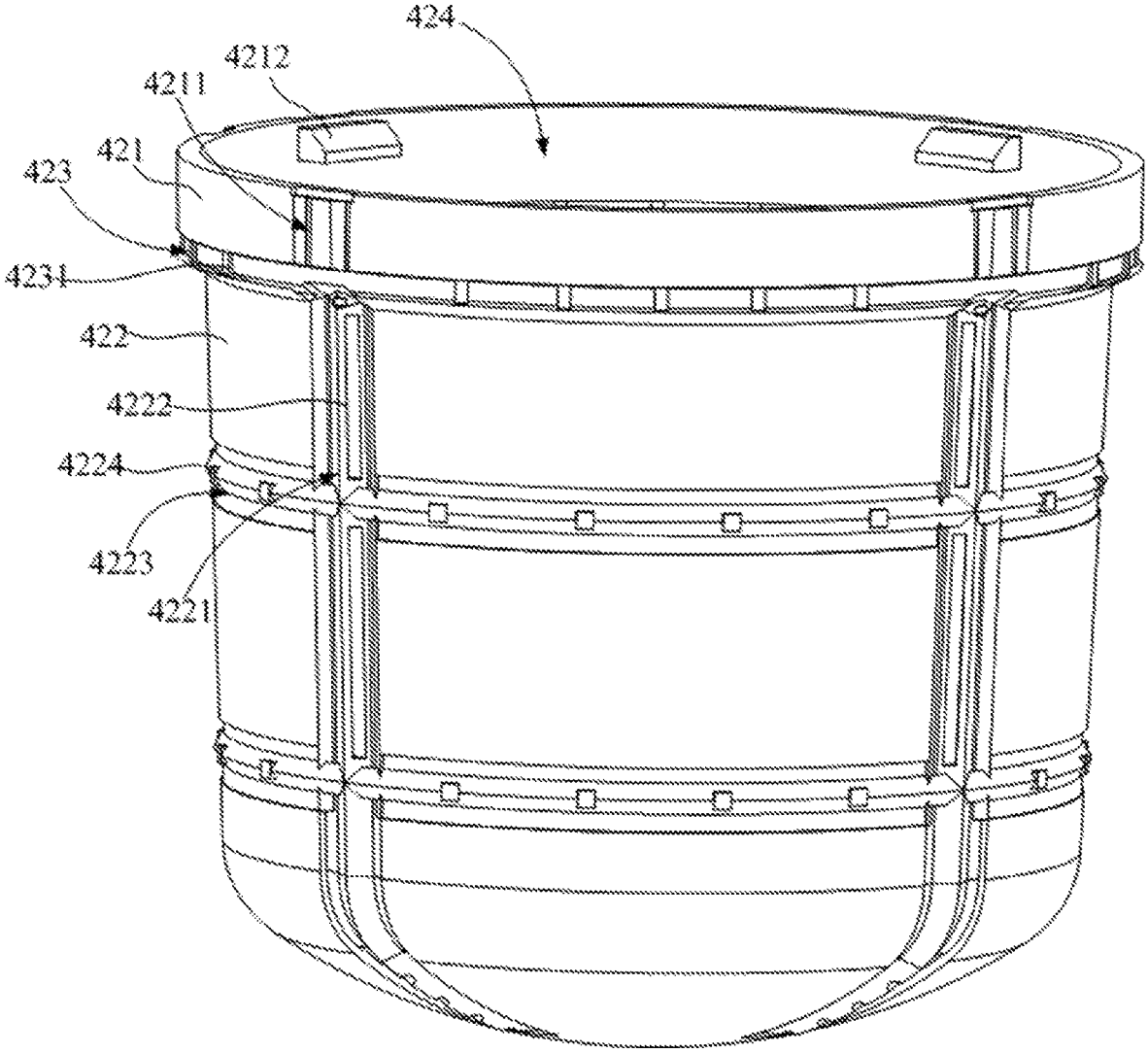
FIG. 9 is the structural schematic diagram of the lampshade body in FIG. 7.

In one embodiment of the utility model, in combination with FIGS. 7, 8 and 9, the peripheral wall of lampshade 4 is also set with protruding airtight rubber strip 434 which embraces the peripheral wall of lampshade 4; The periphery of lampshade 4 is located in several limited spaces 113, and there is elastic compression between airtight rubber strip 434 and mounting groove 11.

In this embodiment, spacing between lampshade 4 and lamp housing is avoided through applying the structure that there is elastic compression between airtight rubber strip 434 and mounting groove 11, and the compressive intensity between lampshade 4 and lamp housing 1 is enhanced, and spacing between lampshade 4 and lamp housing 1 is reduced through applying the structure of airtight rubber strip 434.

In one embodiment of the utility model, the outer wall of airtight rubber strip 434 is set with protruding sealing strip 4341 which embraces sealing strip 434, enhancing the compressive intensity between lampshade 4 and lamp housing 1.

In one embodiment of the utility model, in combination with FIGS. 7, 8 and 9, the anti-collision lampshade 4 comprises: lampshade body 42 and anti-collision layer 43 which is set to 42, avoiding damage and other accidents arising from collision between lampshade body 42 and other objects.

Lampshade body 42 is set with containing groove 424; Understandably, through installing lampshade body 42 to lamp housing 1, a relative independent space of luminous module can be achieved, avoiding damage to luminous module 8 caused by external water vapor, dust or impurities.

The anti-collision layer 43 is installed to the outer surface of lampshade body 42, and anti-collision layer 43 is set with several Light access holes 431 which are laid out in the manner of array. Understandably, anti-collision layer 43 is made of anti-collision materials, such as silicone or rubber. Alternatively, anti-collision layer 43 is made of rubber. And to realize uniform irradiation of light, anti-collision layer 43 is set with several light access holes 431 in a manner of array, enabling that light can be transmitted from each light access hole 431.

In one embodiment of the utility model, lampshade body 42 and anti-collision layer 43 form an integral structure. Understandably, to simplify the assembly structure of lampshade body 42 and anti-collision layer 43, the integrated structure of lampshade body 42 and anti-collision layer 43 can be achieved by means of secondary injection molding. For example, Lampshade body 42 and anti-collision layer 43 can be produced respectively by means of thermal injection molding of their own mold, and then the anti-collision side can be combined with the lampshade body 42 by means of thermal injection molding after secondary heating; Wherein, to enhance the connection intensity between lampshade body 42 and anti-collision layer 43, the surface of lampshade body 42 can be set with grooves or convex pins to enlarge the adhesion intensity between anti-collision layer 43 and lampshade body 42.

In this embodiment, lampshade body 42 is protected from damage arising from collision with external objects by applying a structure that the outer surface of lampshade body 42 is set with anti-collision layer 43; besides, the anti-collision layer 43 is set with several light access holes 431 laid out in the manner of array, facilitating transmission of light; and what's more, the integrated structure of lampshade body 42 and anti-collision layer 43 can improve the intensity of the overall structure of lampshade 4.

In one embodiment of the utility model, anti-collision layer 43 is made of elastic materials; understandably, anti-collision layer 43 is made of rubber.

In one embodiment of the utility model, lampshade body 42 is made of transparent or semi-transparent plastic materials. Alternatively, lampshade body 42 is made of polycarbonate or acrylic materials.

In one embodiment of the utility model, anti-collision layer 43 comprises several anti-collision rubber strips (not identified in figures) connected with lampshade body 42, and several anti-collision rubber strips are set in the manner of interlacing, forming several light access holes 431.

In this embodiment, several anti-collision rubber strips are set on the outer surface of lampshade body 42, protecting lampshade body 42 in an all-round way.

In one embodiment of the utility model, several anti-collision rubber strips back on one side of lampshade body 42, forming inclines. Understandably, when anti-collision rubber strips collide with external objects, the collision direction of the external object will deviate with the guiding function of the incline so that the active force of collision on the anti-collision rubber strip can be scattered.

In one embodiment of the utility model, the outer surface of lampshade body 42 is set with several longitudinal grooves 4221 and several transverse grooves 4223; Several transverse grooves 4223 are set around the periphery of lampshade body 42, and two neighboring transverse grooves 4223 are set at intervals, several longitudinal grooves 4221 and several transverse grooves 4223 are set in the manner of interlacing, and two neighboring longitudinal grooves 4221 are set at intervals; Several anti-collision rubber strips connect with bottom walls of several longitudinal grooves 4221 and those of several transverse grooves 4223. Using several longitudinal grooves 4221 and several transverse grooves 4223, each anti-collision rubber strip is located, enabling stable installation of anti-collision rubber strips.

Understandably, each anti-collision rubber strip connects with the bottom wall of each longitudinal groove 4221 and that of each transverse groove 4223, enabling interlacing arrangement of several anti-collision rubber strips and forming several light access holes 431.

In actual application of the embodiment, several anti-collision rubber strips comprise several transverse rubber strips 432 and several longitudinal rubber strips 433. Each transverse rubber strip 432 connects with the bottom wall of each longitudinal groove 4221, and each longitudinal rubber strip 433 connects the bottom wall of each transverse groove 4223, enabling several light access holes 431 through working together of several transverse rubber strips 432 and several longitudinal rubber strips 433 in the manner of enclosing.

Alternatively, the transverse rubber strip 432 backs on one side of the light assess part 422, forming the first wedged surface 4321 and the second wedged surface 4322 between which there is an angle;

Alternatively, the longitudinal rubber strip 433 backs on one side of the light assess part 422, forming the first guiding incline 4331 and the second guiding incline 4332 between which there is an angle;

In one embodiment of the utility model, the bottom wall of longitudinal groove 4221 is set with several locating protruding blocks 4222; Locating protruding blocks 4222 is used for enlarging the connection area with longitudinal rubber strip 433.

In one embodiment of the utility model, the bottom wall of transverse groove 4223 is set with several protruding power blocks 4224. Locating protruding blocks 4222 is used for enlarging the connection area with transverse rubber strip 432.

In one embodiment of the utility model, in combination with FIG. 9, lampshade body 42 comprises mounting part 421 and the light assess part 422 connecting with the mounting part 421. Mounting part 421 and light assess part 422 form a containing groove 424 in the manner of enclosing;

The periphery of mounting part 421 is set with several locating grooves 4211. The outer surface of light assess part 422 is set with several longitudinal grooves 4221 and several transverse grooves 4223. Each longitudinal groove 4221 connects with each locating groove 4221; Several anti-collision rubber strips connect with the bottom wall of several locating grooves 4211, several longitudinal grooves 4221 and several transverse grooves 4223.

In one embodiment of the utility model, in combination with FIG. 8, there is a sealing groove 423 on the outer surface of light assess part 422 nearby mounting part 421, sealing groove 423 is set around light assess part 422 and mounting part 421, and sealing groove 423 connects with several longitudinal grooves 4221; Anti-collision layer 43 also comprises airtight rubber strip 434 which is set inside the sealing groove 423 and connects with several anti-collision rubber strips. In the embodiment, anti-collision layer 43 is also set with airtight rubber strip 434 which seals spacing between anti-collision lampshade 4 and walls of mounting groove 11.

In one embodiment of the utility model, the bottom wall of sealing groove 423 is set with several protruding power blocks 4231. Locating protruding blocks 4231 is used for enlarging the connection area with airtight rubber strip 434.

In one embodiment of the utility model, one side surface of airtight rubber strip 434 backing on light assess part 422 and mounting part 421 is set with protruding sealing strip 4341 which embraces airtight rubber strip 434.

In one embodiment of the utility model, there is a light access area 4225 on one side of light assess part 422 backing on mounting part 421, anti-collision layer 43 is set with avoidance space 435 corresponding to light access area 4225.

In one embodiment of the utility model, luminous module 8 comprises lamp panel 81 and diode bead 82 connecting with lamp panel 81, lamp 81 is set at the bottom wall of mounting groove 11, and diode bead 82 is set on one side of lamp panel 81 backing on lamp housing 1. Lamp panel 81 is set with a micro control unit which is used for controlling intensity of current output to diode bead 82.

To facilitate heat dissipation of luminous module 8, simple watertight lamp also comprises heat dissipation element 9 which is set on one side of lamp panel 81 backing on diode bead 82 and closely fits with lamp panel 81; Wherein, heat dissipation element 9 can be made of aluminum alloy and have many heat dissipation cavities (not identified in figures).

In one embodiment of the utility model, in combination with FIGS. 1, 2, 4, 5 and 6, each mounting block 12 comprises block body 122 set onto lamp housing 1 and several protruding sealing rubber strips 123 connecting with block body 122, and several protruding sealing rubber strips 123 are set around mounting holes 121;

Watertight cover 2 and block body 122 can be dismounted and connected, and there is elastic compression between watertight cover 2 and several protruding sealing rubber strips 123, enabling that several protruding sealing rubber strips 123 go closer to the center of mounting hole 121 and seal wire.

In this embodiment, the elastic compression structure of the inner wall of watertight cover 2 and several protruding sealing rubber strips 123 enables that several protruding sealing rubber strips 123 go close to the center of mounting hole 121 and seal wire, reducing spacing between lamp housing 1 and wire and improving the sealing intensity between lamp housing 1 and wire.

In one embodiment of the utility model, there are installation threads (not identified in figures) on the outer wall of block body 122, watertight cover 2 has internal threads (not identified in figures), and watertight cover 2 and mounting block 12 can be dismounted and connected through matching of internal threads and mounting threads.

In the embodiment, mounting structure of watertight cover 2 and lamp housing 1 is simplified by designing the structure that watertight cover 2 and mounting block 12 can be dismounted and connected through matching of internal threads and mounting threads, there is elastic compression between the inner wall of watertight cover 2 and several protruding sealing rubber strips 123 by designing the structure of thread matching between watertight cover 2 and mounting block 12, enabling that several protruding sealing rubber strips 123 press wire gradually and the periphery of wire are closely against several protruding sealing rubber strips 123.

Figure 5:
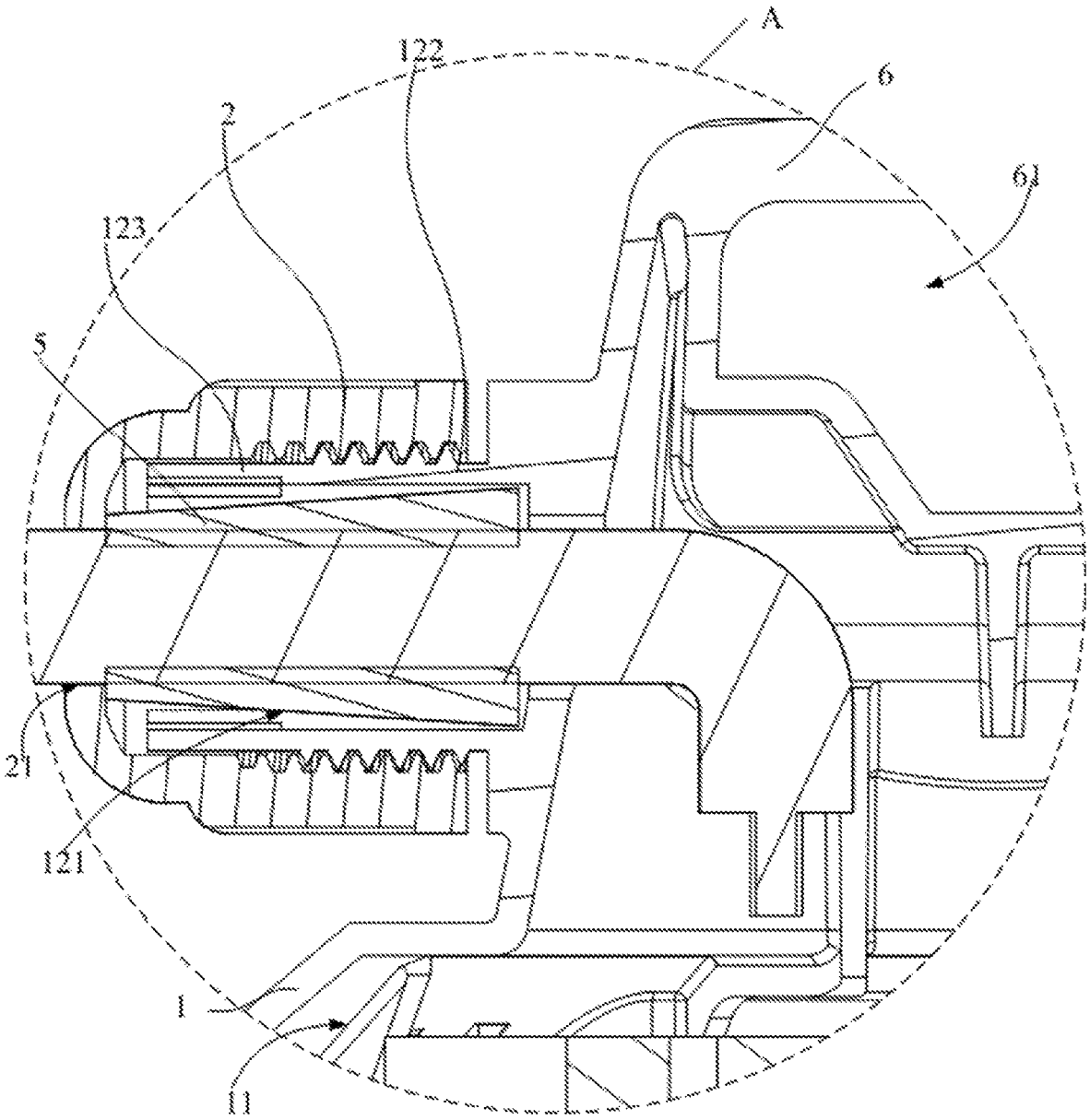
FIG. 5 is the partial enlarged figure of section A in FIG. 4.

In one embodiment of the utility model, combining with FIG. 5 and FIG. 6, the shown simple watertight lamp also comprises two sealed casing rings each of which is contained in each mounting hole 121; There is elastic compression between watertight cover 2 and several protruding sealing rubber strips 123, enabling compression between several protruding sealing rubber strips 123 and sealed casing ring 5 which is used for sealing wire.

In this embodiment, by setting a structure sealed casing ring 5 in each mounting hole 121, the wire goes through the through hole of sealed casing ring 5. When multiple protruding sealing rubber strips 123 locks towards axial direction, multiple protruding sealing rubber strips 123 compress the surface of sealed casing ring 5 to make multiple protruding sealing rubber strips 123 and sealed casing rings 5 jointly seal the wire to improve the tightness of the simple watertight lamp.

In one embodiment of the utility model, the cross-sectional area of sealed casing ring 5 gradually decreases along the direction from lamp housing 1 to watertight cover 2. In other words, when several protruding sealing rubber strips 123 deform, several protruding sealing rubber strips 123 bend inward. To closely fit sealed casing ring 5 as possible, the cross-sectional area of sealed casing ring 5 gradually decreases along the direction from lamp housing 1 to watertight cover 2 so that several protruding sealing rubber strips 123 press the surface of sealed casing ring 5 more comprehensively.

In one embodiment of the utility model, the surface of lampshade 4 is set with several anti-collision rubber strips which are set in the manner of interlacing to form a net structure. It means that a structure of several holes is formed on the surface of lampshade 4 through anti-collision rubber strips which are set in the manner of interlacing. These holes are used for transmitting light. Understandably, several anti-collision rubber strips arranged in the manner of interlacing form several light access holes 431.

In actual application of the embodiment, several anti-collision rubber strips comprise several transverse rubber strips 432 and several longitudinal rubber strips 433 which are set in the manner of interlacing, forming several light access holes 431.

In one embodiment of the utility model, there are several guiding inclines 22 on the outer wall of watertight cover 2. There is an angle between two neighboring guiding inclines 22. Understandably, there are several guiding inclines 22 on the outer wall of the watertight cover 2, facilitating operator's mounting and dismounting of watertight cover 2. In other words, several guiding inclines embrace the side wall of the watertight head to form a polygon, facilitating operator's tightening watertight cover 2 with a wrench.

The utility model also claims a string lamp. In combination with FIGS. 3 and 4, the string lamp comprises plug 7, sealing cover 71 and several simple watertight lamps. See the concrete structure of the simple watertight lamp in the above embodiments. This string lamp applies all the technical schemes in all the above embodiments, so at least the string lamp has all the beneficial effects brought by technical schemes in all the above embodiments. Details will not be described repeatedly herein. Wherein, plug 7 connects electrically with the luminous module 8 of several simple watertight lamps via wire consecutively; Sealing cover 71 and the mounting block 12 at the farthest end of the plug 7 can be dismounted and connected, sealing cover 71 seals the mounting block 12 at the farthest end.

Understandably, watertight cover 2 is set with wire hole 21 between two neighboring simple watertight lamps, facilitating going through of wire; For the mounting block 12 of the simple watertight lamp at the furthest end of plug 7, to realize tightness of the simple watertight lamp, sealing cover 71 and mounting block 12 are adopted to avoid external water vapor entering the simple watertight lamp.

The above description is only the preferred embodiment of the utility model, and it is not for this reason that the patent scope of the utility model is limited. Any equivalent structural transformation made by using the description of the utility model and the appended figures, or direct/indirect application in other related innovation fields under the inventive concept of the utility model, is included in the patent protection scope of the utility model.

What is claimed is:

1. A simple watertight lamp, comprising:

a lamp housing set with a mounting groove and two mounting blocks, containing a mounting hole connecting the mounting groove which is used for mounting a luminous module;

a hanger loop which is on a back on one side of the mounting groove together with the lamp housing and connects with the lamp housing to form a hanger loop mouth;

two watertight covers, each of which is set with a wire hole and can be dismounted and connected with each said mounting block, enabling that the watertight cover and the mounting block fit each other to seal the wire which goes through the wire hole; and a lampshade which is installed to the lamp housing and sealed in the mounting groove, wherein the bottom wall of the mounting groove is set with several protruding buckle placement positions each of which connects with the side wall of the mounting groove to form a limited space, wherein the inner wall of the said lampshade is set with several buckles, and wherein the periphery of the lampshade is located in several said limited spaces, enabling the lampshade to be installed to the lamp housing by virtue of matching of several buckles and several buckle placements positions.

2. The simple watertight lamp as claimed in claim 1, wherein the peripheral wall of the lampshade is set with an alignment groove;

the inner wall of the mounting groove is set with protruding limited posts which are set together with the several buckle placement positions in the manner interval; and the periphery of the lampshade is located in several said limited spaces, and the limited post is contained in the alignment groove.

3. The simple watertight lamp as claimed in claim 1, wherein the peripheral wall of the lampshade is also set with protruding airtight rubber strips which are set around the peripheral wall of the lampshade; and the periphery of the lampshade is located in several said limited spaces, and there is elastic compression between the airtight rubber strip and the mounting groove.

4. The simple watertight lamp as claimed in claim 1, wherein the surface of the lampshade is set with several anti-collision rubber strips which are set an interlacing manner to form a net structure.

5. The simple watertight lamp as claimed in claim 4, wherein the anti-collision rubber strip is an elastic material, the lampshade comprises a lampshade body which is transparent or semi-transparent plastic material.

6. The simple watertight lamp as claimed in claim 5, wherein the outer surface of the lampshade body is set with several longitudinal grooves and several transverse grooves;

several transverse grooves set around the periphery of the lampshade body, and the neighboring two transverse grooves are set at intervals, several longitudinal grooves and several said transverse grooves are set in an interlacing manner, and two neighboring longitudinal grooves are set at intervals; and several anti-collision rubber strips connect with the bottom wall of the several said longitudinal grooves and that of several said transverse grooves.

7. The simple watertight lamp as claimed in claim 6, wherein the lampshade body comprises the mounting part and the light assess part connecting with the mounting part, and the mounting part and the light assess part form the containing groove in the manner of enclosure;

there are several locating grooves on the periphery of the mounting part, there are several longitudinal grooves and several transverse grooves on the outer surface of the light assess part, and each said longitudinal groove connects with each said locating groove; and several anti-collision rubber strips connect with the bottom wall of the several said locating grooves and multiple said longitudinal grooves and that of several said transverse grooves.

8. The simple watertight lamp as claimed in claim 7, wherein the light assess part back on one side of the mounting part, forming a light access area, and the anti-collision layer is set with an avoidance space corresponding to the light access area.

9. The simple watertight lamp as claimed in claim 4, wherein the several said anti-collision rubber strips back on one side of the lampshade body and form guiding inclines.

10. A string lamp comprising:

a plug;

a sealing cover; and a plurality of simple watertight lamps according to claim 1, wherein the plug connects electrically with the luminous module of the plurality of simple watertight lamps via wire consecutively, wherein the sealing cover and the mounting block at a farthest end of the plug can be dismounted and connected, and wherein the sealing cover can seal the mounting block at the farthest end.

11. A simple watertight lamp, comprising:

a lamp housing set with a mounting groove and two mounting blocks, containing a mounting hole connecting the mounting groove which is used for mounting a luminous module;

a hanger loop which is on a back on one side of the mounting groove together with the lamp housing and connects with the lamp housing to form a hanger loop mouth;

two watertight covers, each of which is set with a wire hole and can be dismounted and connected with each said mounting block, enabling that the watertight cover and the mounting block fit each other to seal the wire which goes through the wire hole; and a lampshade which is installed to the lamp housing and sealed in the mounting groove, wherein the luminous module comprises a lamp panel and the diode bead for electric connection of the lamp panel, the lamp panel is set onto the bottom wall of the mounting groove, and the diode bead is set onto the lamp panel back on one side of the lamp housing.

12. The simple watertight lamp as claimed in claim 11, wherein the surface of the lampshade is set with several anti-collision rubber strips which are set an interlacing manner to form a net structure.

13. A string lamp comprising:

a plug;

a sealing cover; and a plurality of simple watertight lamps according to claim 11, wherein the plug connects electrically with the luminous module of the plurality of simple watertight lamps via wire consecutively, wherein the sealing cover and the mounting block at a farthest end of the plug can be dismounted and connected, and wherein the sealing cover can seal the mounting block at the farthest end.

14. A simple watertight lamp, comprising:

a lamp housing set with a mounting groove and two mounting blocks, containing a mounting hole connecting the mounting groove which is used for mounting a luminous module;

a hanger loop which is on a back on one side of the mounting groove together with the lamp housing and connects with the lamp housing to form a hanger loop mouth;

two watertight covers, each of which is set with a wire hole and can be dismounted and connected with each said mounting block, enabling that the watertight cover and the mounting block fit each other to seal the wire which goes through the wire hole; and a lampshade which is installed to the lamp housing and sealed in the mounting groove, wherein each mounting block comprises the block body set to the lamp housing and several protruding sealing rubber strips connected with the block body, and several protruding sealing rubber strips are set around the mounting hole, and wherein the watertight cover and the block body can be dismounted and connected, and there is elastic compression between the watertight cover and several said protruding sealing rubber strips, enabling several said protruding sealing rubber strips to go closer to the mounting hole and sealing wire.

15. The simple watertight lamp as claimed in claim 14, wherein there are mounting threads on the outer wall of the block body, the watertight cover contains internal threads, and the watertight cover and the mounting block can be dismounted and connected by virtue of matching of the internal thread and the mounting thread.

16. The simple watertight lamp as claimed in claim 14, wherein the simple watertight lamp also comprises two sealed casing rings each of which is contained in each mounting hole; and there is elastic compression between the watertight cover and the several protruding sealing rubber strips, enabling that several said protruding sealing rubber strips press the sealed casing ring to make the wire be sealed in the sealed casing ring.

17. A string lamp comprising:

a plug;

a sealing cover; and a plurality of simple watertight lamps according to claim 14, wherein the plug connects electrically with the luminous module of the plurality of simple watertight lamps via wire consecutively, wherein the sealing cover and the mounting block at a farthest end of the plug can be dismounted and connected, and wherein the sealing cover can seal the mounting block at the farthest end.

18. The simple watertight lamp as claimed in claim 14, wherein the surface of the lampshade is set with several anti-collision rubber strips which are set an interlacing manner to form a net structure.

* * * * *